US008127596B2

(12) United States Patent
Grunwald et al.

(10) Patent No.: US 8,127,596 B2
(45) Date of Patent: Mar. 6, 2012

(54) METHOD FOR VERIFYING THE TIGHTNESS OF A TANK BLEEDING SYSTEM WITHOUT USING A PRESSURE SENSOR

(75) Inventors: Oliver Grunwald, Ingolstadt (DE); Alexander Ketterer, Pettendorf/Adlersberg (DE)

(73) Assignee: Continental Automotive GmbH, Hannover (DE)

( * ) Notice: Subject to any disclaimer, the term of this patent is extended or adjusted under 35 U.S.C. 154(b) by 779 days.

(21) Appl. No.: 12/093,558

(22) PCT Filed: Oct. 19, 2006

(86) PCT No.: PCT/EP2006/067568

§ 371 (c)(1),
(2), (4) Date: Oct. 6, 2008

(87) PCT Pub. No.: WO2007/057273

PCT Pub. Date: May 24, 2007

(65) Prior Publication Data

US 2009/0090171 A1 Apr. 9, 2009

(30) Foreign Application Priority Data

Nov. 17, 2005 (DE) ..... 10 2005 054 880

(51) Int. Cl.
*G01M 3/26* (2006.01)

(52) U.S. Cl. ..... 73/40.5 R; 73/49.2; 73/49.3

(58) Field of Classification Search ..... 73/40–49.8
See application file for complete search history.

(56) References Cited

U.S. PATENT DOCUMENTS

| | | | | | |
|---|---|---|---|---|---|
| 5,146,902 | A | * | 9/1992 | Cook et al. | 123/518 |
| 5,191,870 | A | * | 3/1993 | Cook | 123/520 |
| 5,476,083 | A | * | 12/1995 | Blumenstock | 123/520 |
| 5,629,477 | A | * | 5/1997 | Ito | 73/114.39 |
| 5,957,115 | A | * | 9/1999 | Busato et al. | 123/520 |
| 5,967,124 | A | * | 10/1999 | Cook et al. | 123/520 |
| 6,041,648 | A | | 3/2000 | Angermaier et al. | 73/118.1 |
| 6,073,487 | A | * | 6/2000 | Dawson | 73/114.39 |

(Continued)

FOREIGN PATENT DOCUMENTS

DE 197 13 085 A1 10/1998

(Continued)

OTHER PUBLICATIONS

Written Opinion of the International Searching Authority (Supplementary Sheet), PCT/EP2006/067568, 4 pages, 2004.

*Primary Examiner* — David Rogers
(74) *Attorney, Agent, or Firm* — King & Spalding L.L.P.

(57) ABSTRACT

In a method for verifying the tightness of a tank bleeding system with a tank bleeding valve, a stop valve for air-tightly closing the tank bleeding system relative to an atmosphere prevailing outside the motor vehicle, and a bistable pressure switch whose switched condition indicates whether a predefined switching pressure is exceeded or not reached in the tank bleeding system, in order to be able to determine the tightness of the tank bleeding system without using a pressure sensor, the following steps are carried out: waiting until the vehicle speed drops below a certain threshold; opening the tank bleeding valve; closing the tank bleeding valve when a negative pressure has been attained which lies below the switching pressure; measuring the duration from the time an initial pressure lies below the switching pressure until the moment the switching pressure is exceeded again; and assessing the tightness is assessed based on the measured duration.

20 Claims, 4 Drawing Sheets

U.S. PATENT DOCUMENTS

| | | | | |
|---|---|---|---|---|
| 6,082,189 | A | 7/2000 | Bayerle et al. | 73/118.1 |
| 6,192,743 | B1 * | 2/2001 | Perry | 73/40 |
| 6,283,098 | B1 | 9/2001 | Corkill | 123/520 |
| 6,301,955 | B1 * | 10/2001 | Cook et al. | 73/49.7 |
| 6,314,797 | B1 * | 11/2001 | Dawson et al. | 73/49.2 |
| 6,343,505 | B1 * | 2/2002 | Cook et al. | 73/114.39 |
| 6,550,316 | B1 | 4/2003 | Wong et al. | 73/49.7 |
| 6,666,072 | B2 * | 12/2003 | Hirano et al. | 73/49.7 |
| 6,761,058 | B2 * | 7/2004 | Yamaguchi et al. | 73/40.5 R |
| 6,807,851 | B2 * | 10/2004 | Wakahara et al. | 73/114.39 |
| 6,832,509 | B2 * | 12/2004 | Morinaga et al. | 73/114.39 |
| 6,848,298 | B2 * | 2/2005 | Miyahara et al. | 73/49.2 |
| 6,945,093 | B2 * | 9/2005 | Amano et al. | 73/49.7 |
| 6,966,214 | B2 * | 11/2005 | Watanabe et al. | 73/49.2 |
| 6,970,775 | B2 | 11/2005 | Lederle et al. | 701/29 |
| 7,004,013 | B2 * | 2/2006 | Kobayashi et al. | 73/49.7 |
| 7,137,288 | B2 * | 11/2006 | Kobayashi et al. | 73/49.7 |
| 7,347,194 | B2 * | 3/2008 | Sato | 123/520 |
| 7,383,722 | B2 * | 6/2008 | Tsuyuki et al. | 73/49.7 |
| 7,418,856 | B2 * | 9/2008 | Kohler | 73/49.7 |
| 2001/0027680 | A1 * | 10/2001 | Fabre | 73/49.7 |
| 2001/0029933 | A1 | 10/2001 | Fabre | 123/520 |
| 2002/0069692 | A1 * | 6/2002 | Cook et al. | 73/49.7 |
| 2003/0061864 | A1 * | 4/2003 | Wong et al. | 73/40 |
| 2004/0200460 | A1 * | 10/2004 | Mitani et al. | 123/520 |
| 2006/0162705 | A1 | 7/2006 | Grunwald et al. | 123/520 |

FOREIGN PATENT DOCUMENTS

| | | | |
|---|---|---|---|
| DE | 102 45 158 | A1 | 4/2003 |
| DE | 196 47 409 | C2 | 5/2003 |
| DE | 103 12 588 | A1 | 9/2004 |
| DE | 10 2005 003 924 | A1 | 8/2006 |
| WO | WO 94/06264 | A1 * | 3/1994 |

* cited by examiner

METHOD FOR VERIFYING THE TIGHTNESS OF A TANK BLEEDING SYSTEM WITHOUT USING A PRESSURE SENSOR

CROSS-REFERENCE TO RELATED APPLICATIONS

This application is a U.S. national stage application of International Application No. PCT/EP2006/067568 filed Oct. 19, 2006, which designates the United States of America, and claims priority to German application number 10 2005 054 880.6 filed Nov. 17, 2005, the contents of which are hereby incorporated by reference in their entirety.

TECHNICAL FIELD

The invention relates to a method for verifying the tightness of a tank venting system of a motor vehicle.

BACKGROUND

In such systems, the tank venting system has a tank venting valve in a regeneration line which connects a storage container collecting fuel vapors from a fuel tank with an intake pipe of an internal combustion engine, a stop valve for sealing the tank venting system such that it is air-tight relative to an atmosphere prevailing outside the motor vehicle, and a bistable pressure switch, the switched state of which indicates whether a predefined switching pressure is exceeded or not reached in the tank venting system.

In the usual methods used to verify the tightness of a tank venting system while a motor vehicle is in motion, as described in DE-19713085-A1 for example, the tank venting valve is opened so that the negative pressure in the intake pipe can disperse in the tank venting system. Once the tank venting valve has been subsequently closed, the pressure should remain approximately at the level of the negative pressure reached. Both the extent of the negative pressure reached as well as the period until this negative pressure is reached and the behavior of the pressure after the tank venting valve is closed enable conclusions to be drawn regarding a possible leak in the tank venting system. A pressure sensor is required in order to be able to continually observe and monitor the pressure curve.

By way of contrast, various methods for verifying a possible leak in a tank venting system which can be performed when the engine is switched off are known from DE 102 45 158 A1. In one of these methods, the drop in the engine coolant temperature after the warm engine is switched off is observed. If there is a sufficiently small temperature, it is assumed that the fuel tank has also cooled and that the pressure prevailing in the tank venting system has also dropped. At the same time, a vacuum switch is monitored which is triggered at a certain negative pressure. If the vacuum switch has not been triggered even though the temperature has already dropped sufficiently, it is suggested that there is a leak in the tank venting system.

The advantage in this method lies in that a pressure sensor is no longer required. The considerably more reasonably priced vacuum switch or pressure switch reduces the cost of the method. However, the comparatively long waiting time of up to several hours until the temperature has dropped sufficiently to be able to come to a reliable conclusion about the existence of a leak is disadvantageous.

SUMMARY

According to an embodiment, a method of the type mentioned above can be specified with which the time required for verifying the tightness of the tank venting system is reduced and without the use of a pressure sensor. According to various embodiments, a method for verifying the tightness of a tank venting system of a motor vehicle comprising a tank venting valve in a regeneration line, which connects a storage container collecting fuel vapor from a fuel tank to an intake pipe of an internal combustion engine, a stop valve for sealing the tank venting system so that it is air-tight against an atmosphere prevailing outside the vehicle and a bistable pressure switch, the switching states of which indicate that the pressure in the tank venting system is above or below a predetermined switching pressure, the method comprising the steps:—Waiting for the vehicle speed to drop below a threshold,—Opening the tank venting valve,—Closing the tank venting valve when a negative pressure has been attained that is below the switching pressure,—Measuring the period from an initial pressure that is below the switching pressure until the next time the pressure exceeds the switching pressure,—Assessing the tightness using the measured duration.

According to a further embodiment, once the tank venting valve is opened, a constant volumetric flow through the tank venting valve may be regulated by means of varying the degree of opening of said valve and that the stop valve is opened at the same time as the tank venting valve and the degree of opening of the stop valve is varied such that the pressure alternately drops below, exceeds and then again drops below the switching pressure at least once in succession, whereupon the stop valve is closed, while the tank venting valve remains open for a defined period. According to a further embodiment, the duration between the closing of the stop valve and the next time the pressure exceeds the switching pressure may be determined as the sum of defined duration and the duration until the switching pressure is exceeded. According to a further embodiment, the stop valve may be closed when the vehicle speed has reached zero. According to a further embodiment, during the varying of the degree of opening of the stop valve, a value for escaping fuel vapor may be determined from the regulated cycle of changes of pressure above and below the switching pressure and from a value for the charge state of the storage container with fuel vapor. According to a further embodiment, a membrane may be provided which is able to form a connection between the tank venting system and the atmosphere prevailing outside the vehicle, whereby the membrane opens slightly at a specified negative pressure that is less than the switching pressure, and that the tank venting valve is held open after the pressure has dropped below the switching pressure for the first time until the specified negative has been reliably achieved. According to a further embodiment, the stop valve may be actuated with a pulse at the same time the tank venting valve closes and that the membrane is thus abruptly closed. According to a further embodiment, the stop valve may be actuated before the pulse in such a way that there is a constant and very small degree of opening. According to a further embodiment, the tank venting valve may not be closed until the vehicle speed has reached zero. According to a further embodiment, during the measuring of the duration until the switching pressure is exceeded, the vehicle may be monitored to determine whether it still has a vehicle speed of zero.

BRIEF DESCRIPTION OF THE DRAWINGS

The invention is described in more detail below with reference to exemplary embodiments and drawings, in which.

DETAILED DESCRIPTION

Figure 1:
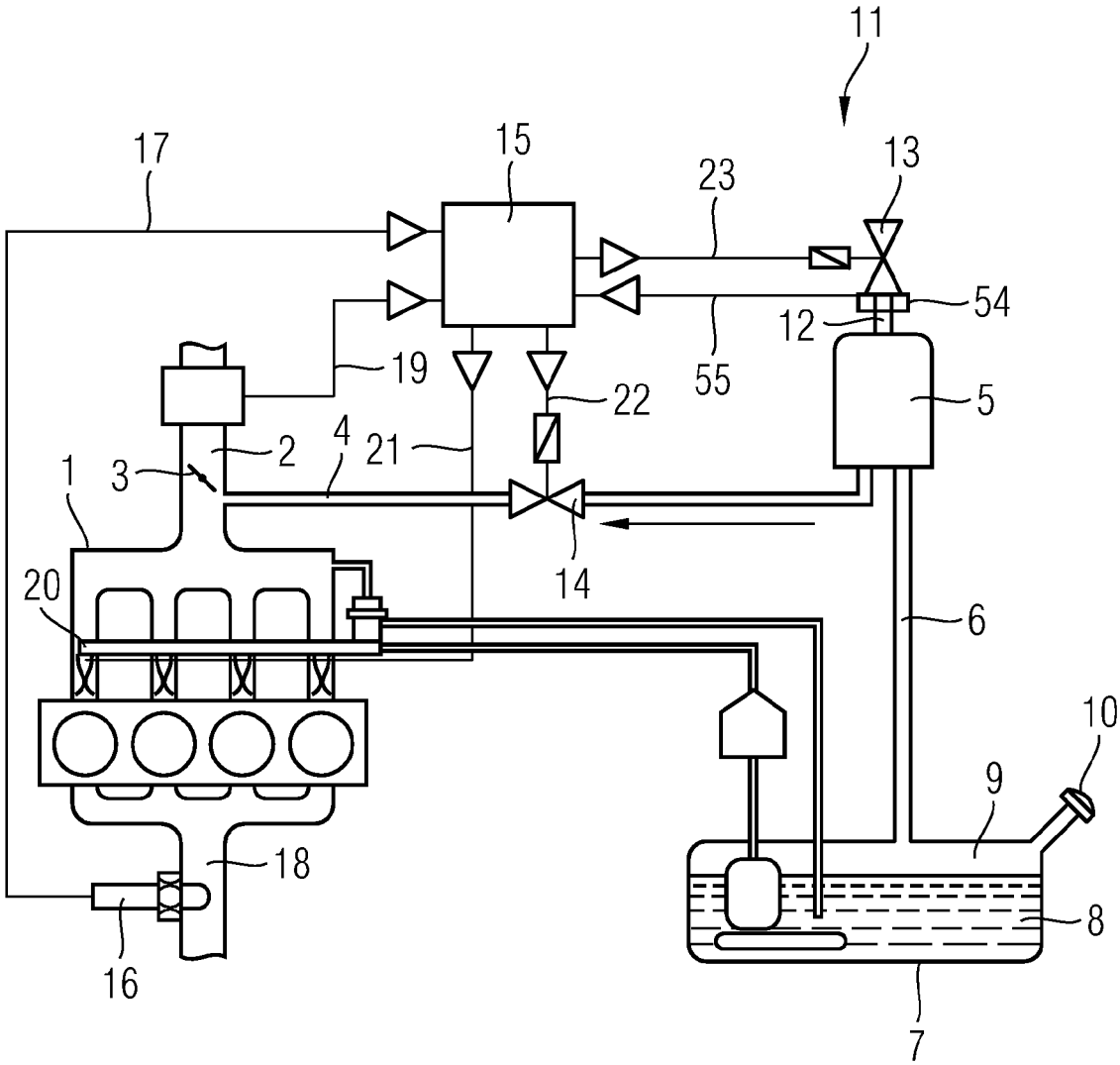
FIG. 1 shows an internal combustion engine with fuel tank and tank venting system.

According to various embodiments, the method may start with checking whether the vehicle has dropped below a threshold for vehicle speed. This threshold is selected so as to be low enough that strong vibrations of the vehicle need no longer be expected, i.e. the threshold is in a range close to the vehicle being stationary, preferably 10 km/h or less. Once the speed has dropped below the threshold, the tank venting valve is opened so that the pressure in the tank venting system drops due to the negative pressure in the intake pipe. The tank venting valve is kept open until a negative pressure has been attained that lies below the switching pressure. Because the switching pressure is selected so that it lies below the pressure that prevails in the tank venting system under normal operating conditions, this means that, while the tank venting valve is open, the pressure drops below the switching pressure at least once, so that the pressure switch is triggered accordingly. Once the tank venting valve has closed, the duration until the switching pressure is exceeded again is measured, starting from an initial pressure that is less than the switching pressure. The tightness of the tank venting system is then assessed using the measured duration. Essential to the method according to various embodiments is the determination of a defined negative pressure that lies below the switching pressure and that can also be designated as the initial pressure. Starting from this initial pressure, the duration is then determined until the next time the pressure switch is triggered due to the switching pressure being exceeded. Using the values of the initial pressure, switching pressure and duration, a pressure build-up rate can be calculated, the value of which is used as an indicator of whether there is a leak or not. However, it is also sufficient to assess only the value of the measured duration, because the pressure difference always remains constant. Essentially, the quicker the pressure build-up, the more likely a leak is present or the greater any leak.

The advantage of the method is that, on the one hand, there may be no need for a pressure sensor, because, as the initial pressure is known, it is only necessary to determine a second pressure, which is possible using a simple pressure switch. On the other hand, it may no longer be necessary to wait several hours until a negative pressure is attained in the tank venting system due to natural reduction in temperature; instead the negative pressure is generated systematically and within a few seconds by opening the tank venting valve.

The initial pressure is generated in two different ways according to various embodiments.

In one embodiment, a constant volumetric flow is regulated through the tank venting valve after the tank venting valve is opened by varying the degree to which the latter is opened. This is achieved by the actuation of the tank venting valve by means of an appropriate PWM signal according to the known methods (e.g. DE 10 2005 003 924). The stop valve is opened at the same time as the tank venting valve and the degree to which the stop valve is opened is varied such that the pressure alternately and successively drops below, exceeds and then again drops below the switching pressure. This process is also known as toggling around the switching pressure, whereby the stop valve is preferably again actuated by means of a PWM signal. The stop valve is then closed, while the tank venting valve remains open for a fixed duration.

While the tank venting valve and stop valve are open at the same time and before the toggling begins, the pressure in the tank venting system drops, despite the air flowing in from the outside atmosphere, because the volumetric flow through the tank venting valve is greater than that through the stop valve. Accordingly, the pressure drops below the switching pressure for the first time. Once the switching pressure has been dropped below for the first time, the toggling around the switching pressure begins, i.e. the opening in the stop valve is first enlarged until the switching pressure is exceeded again, and then reduced until pressure next drops below the switching pressure again. The pressure in the tank venting system is thus regulated to the switching pressure, whereby the alternate enlarging and reducing of the opening of the stop valve can be repeated as often as required. Starting from the switching pressure as a fixed initial value, a drop in pressure is then generated for a defined duration with the stop valve closed. This drop in pressure occurs in every case so that, at the end of the defined duration, the initial pressure is present from which the subsequent duration until the next time the switching pressure is exceeded is measured. The shorter the duration until the switching pressure is exceeded, the greater the size of any leak. Alternatively, the total of the defined duration and measured duration can be calculated and assessed. The variation according to the size of a leak is even clearer here, because any leak prevents a particularly low pressure from being reached during the pressure reduction within the defined duration, which already shortens the subsequent duration of the pressure build-up until the switching pressure is exceeded. Furthermore, the pressure build-up is accelerated by the leak, such that the total duration is much shorter than with an intact tank venting system. The calculation of the total of the durations thus utilizes a dual effect of the reduced time as a consequence of a leak.

In order to increase the precision of the method, in an embodiment, the stop valve is not closed until the vehicle speed has reached zero, because various operational influences can distort the pressure curve in the tank venting system when the vehicle is in motion.

According to a further embodiment, a value is determined for the fuel vapor flowing out of the storage container while the degree that the stop valve is open is being varied. This value is determined using the set cycle of alternation between the pressure exceeding and falling below the switching pressure and using the charge level of the storage container with fuel vapor. If the calculated value for fuel vapor flowing out is within an expected range, which primarily depends on the charge level, it is concluded that there is at least a small leak. Because this method only permits a rough estimate, it is used to identify whether there is a large leak of greater than 1 mm in diameter. This conclusion is then checked and substantiated by means of the following duration measurement.

The generation of the initial pressure that is below the switching pressure by toggling around the switching point with an initial opening of the tank venting valve for a fixed duration is particularly suitable for stop valves in which the degree to which it is opened can be fractionally varied. For stop valves with which the precision adjustment of a desired opening of this type is not directly possible, a second method for generating the initial pressure is suggested.

According to an alternative embodiment, a membrane is provided to create a connection between the tank venting system and the atmosphere prevailing outside the motor vehicle. The membrane either forms a connection with the atmosphere in addition to the stop valve or, in an appropriately designed embodiment, it can take on the full functionality of the stop valve. The membrane opens to a minimal degree at a specified negative pressure, which is less than the switching pressure. Once the pressure falls below the switching pressure for the first time, the tank venting valve is then held open until the specified negative pressure is reliably achieved.

In terms of its shape and the selected material, the membrane is designed in such a way that it deforms at the specified negative pressure, so that air from the outside atmosphere can flow into the tank venting system. This prevents the falling pressure caused by the opening of the tank venting valve from falling to a level that would result in the damage or destruction of the tank and/or the tank venting system. The specified negative pressure is thus greater than the pressure level that would cause damage.

The longer opening of the tank venting valve for a duration of a few seconds ensures that the specified negative pressure is reliably achieved. This is then designated as the initial pressure, i.e. once the specified negative pressure has been reliably achieved, the tank venting valve is closed and the duration until the next time the switching pressure is exceeded is determined in order to assess the tightness.

In an embodiment with a stop valve and additional membrane, the stop valve is actuated with a pulse at the same time that the tank venting valve is closed and the membrane is thus abruptly closed. This prevents the conclusion about tightness from being distorted by the membrane deformation which would otherwise still be present. If the membrane is not closed at the same time as the tank venting valve, the proportion of the air flowing in via the membrane would have to be deducted from the duration of the pressure build-up from the initial pressure to the switching pressure.

In a development of the embodiment, the stop valve is actuated before the pulse in such a way that a constant and very small opening is present. In this way, the specified negative pressure at which the membrane deforms can be influenced and set to a desired value.

Also in the alternative embodiment in which the initial pressure is generated by means of the deformable membrane, the precision of the tightness verification can be increased whereby the tightness verification is performed when the vehicle is stationary. In a development, the tank venting valve is therefore not closed until the vehicle speed has reached zero.

According to a development in all embodiments mentioned, the vehicle is monitored during the measuring of the duration until the switching pressure is exceeded to determine whether it is still exhibiting a vehicle speed of zero. As soon as the vehicle starts to move again, i.e. as soon as a low speed threshold is exceeded, the method is cancelled in order to prevent incorrect conclusions.

The internal combustion engine 1 of a motor vehicle shown in FIG. 1 has an intake pipe 2 in which a throttle valve 3 is located. The intake pipe 2 is connected to a storage container 5 of a tank venting system by means of a regeneration line 4, and the storage container 5 is in turn connected to a fuel tank 7 by means of a venting line 6. The fuel vapor 9 that collects above the liquid fuel 8 in the fuel tank 7 is routed via the venting line 6 into the storage container 5, where it is trapped in an activated carbon filter. The fuel tank 7 is closed by means of a tank cap 10. The storage container 5 is connected to the external atmosphere 11 by means of a ventilation line 12. This connection can be interrupted by means of a stop valve 13, whereby a bistable pressure switch 54 is arranged in the stop valve which emits a switching signal 55 which alternates between low and high. A tank venting valve 14 is arranged in the regeneration line 4. Several sensor measurements from the internal combustion engine are fed to an engine control unit 15, containing a computing unit among other things, for example the air fuel ratio 17 of the exhaust emitted from the internal combustion engine 1 via an exhaust system 18 that is determined by means of a λ sensor 16, as well as the gas mass flow rate 19 of the air sucked into the internal combustion engine 1 by means of the intake pipe 2. The computing unit of the engine control unit 15 uses these and other measurements, such as the speed and torque of the internal combustion engine 1 to determine various actuating variables for influencing the operation of the internal combustion engine 1, for example the injection time 21 which is to be set in an injection system 20 for introducing fuel. Furthermore, the computing unit of the engine control unit 15 calculates the degree of opening 22 of the tank venting valve 14 and the degree of opening 23 of the stop valve 13 and controls both valves 13 and 14 by means of appropriate PWM signals.

Figure 2:
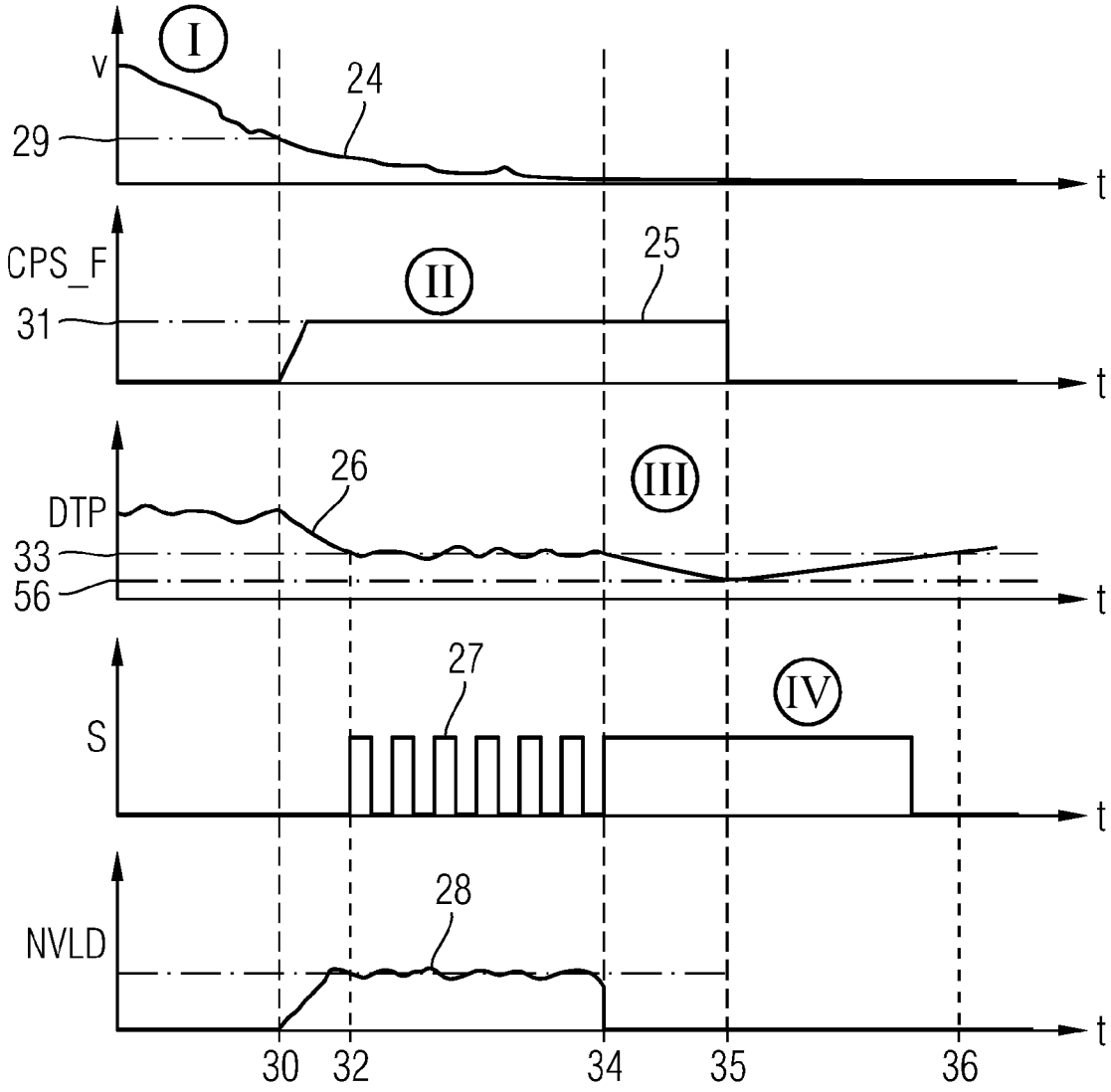
FIG. 2 shows chronological sequences during a first embodiment of the tightness verification.

FIG. 2 shows the temporal course of a tightness verification, in which the toggling around the switching pressure takes place. The various curves show in detail: the path of the vehicle speed 24 (v), the path of the volumetric flow 25 through the tank venting valve 14 (CPS_F), the path of the pressure 26 inside the tank venting system (DTP), the switching status 27 of the pressure switch (S), and the degree of opening 28 of the stop valve 13.

The path of the pressure 26 is only given here for illustration purposes. It is not measured during normal operation, because there is no pressure sensor in the tank venting system. A total of four periods are indicated with Roman numerals. Period I represents an initial phase; the switching pressure 33 is set in period II; the initial pressure below the switching pressure is reached in period III; and the pressure build-up for the tightness verification takes place in period IV. The processes are described in more detail below.

In time period I, the vehicle speed 24 slowly drops, because the vehicle is rolling up to a junction for example. As soon as the speed drops below the speed threshold 29 of 6 km/h for example at point in time 30, the tank venting valve 14 is opened in a controlled manner by means of a PWM signal so that the volumetric flow 25 increases linearly until it is maintained at a desired constant value 31. At the same time, the stop valve 13 is opened in a controlled manner, as can be seen from its degree of opening 28. The reduction in the pressure 26 regulated by the opening of the tank venting valve 14 causes the pressure 26 to drop below the switching pressure 33 for the first time at point in time 32. A maximum of 2 seconds pass between point in time 30 and point in time 32. Now the toggling around the switching pressure 33 begins, i.e. the PWM signal for actuating the stop valve 13 is varied in such a way that the pressure alternately exceeds and drops below the switching pressure 33 several times, as can be seen from the switching status 27 of the pressure switch. At point in time 34, the vehicle reaches a standstill, i.e. the speed is zero and the engine is idling. Because, at this point in time 34, the switching pressure 33 in the tank ventilation system has already been regulated, i.e. because the switching pressure 33 has alternately dropped below, exceeded and then again dropped below the switching pressure 33 at least once in succession, the stop valve 13 is closed. The tank venting valve 14 remains open for a previously determined duration in period III, which causes the pressure 26 in the tank venting system to drop below the switching pressure 33 until it reaches an initial pressure 56. At point in time 35, the tank venting valve 14 is also closed. Due to the natural emission of fuel vapor 9, the pressure 26 now begins to climb again. The duration between point in time 35 and the next time the pressure switch is triggered at point in time 36 is measured and added to the defined duration of period III. In this example, there is no leak present, i.e. the total duration is sufficiently long.

Figure 3:
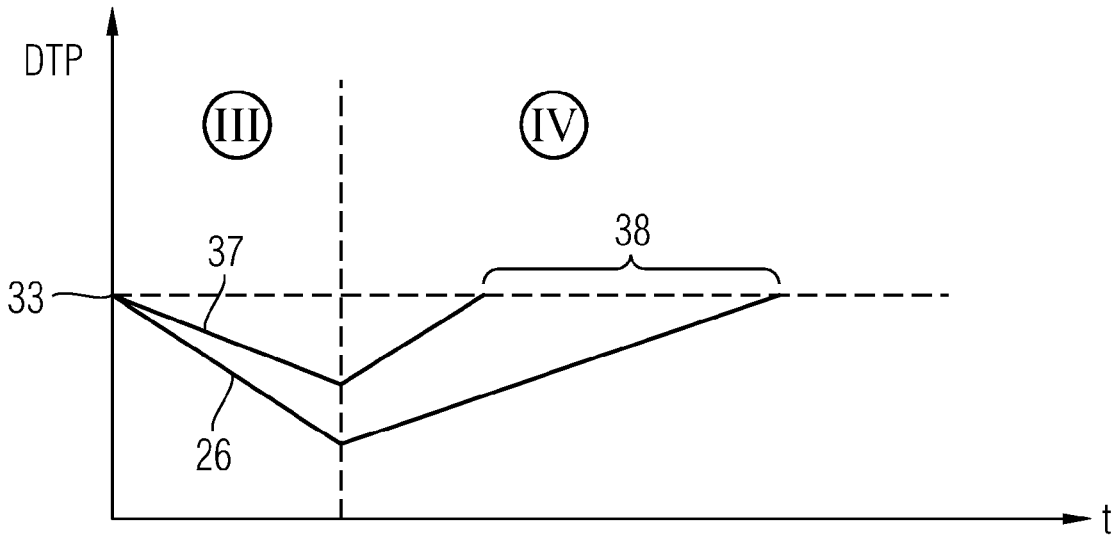
FIG. 3 shows a comparison of the pressure reduction and pressure build-up times with and without a leak.

In FIG. 3, the path of the pressure 26 in periods III and IV is compared to a pressure 37 where a leak is present. As a consequence of the leak, the pressure 37 drops more slowly during the opening phase of the tank venting valve 14 in period III, because air from the atmosphere 11 is able to enter the tank venting system. Once the tank venting valve 14 has closed, the pressure 37 also climbs more quickly, because not only fuel vapor 9 from the tank 7 is flowing in, but also air from the outside. Due to this dual effect, there is a clear difference 38 between when pressure 37 and pressure 26 exceed the switching pressure 33, i.e. a clear conclusion can be made about the presence of a leak.

Figure 4:
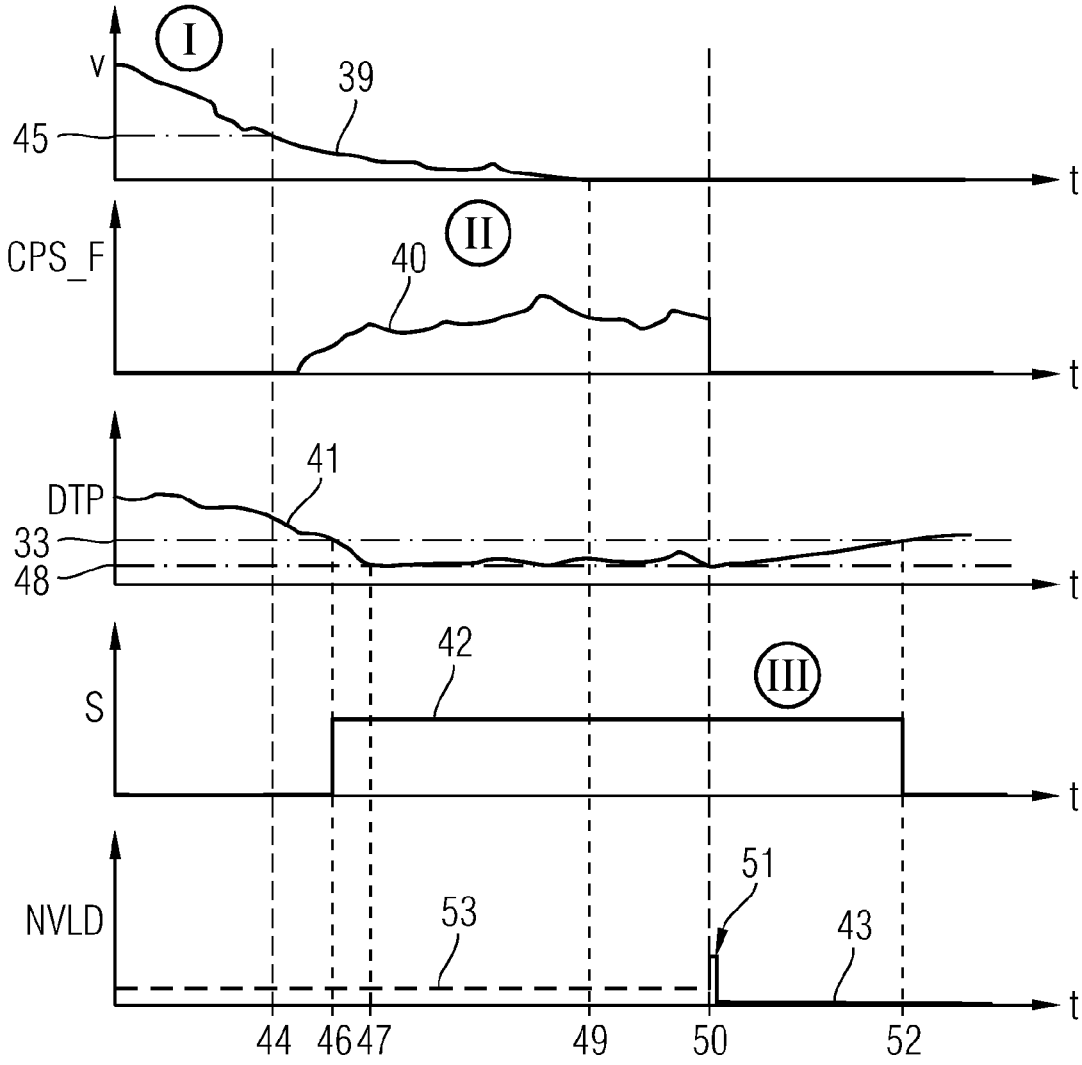
FIG. 4 shows chronological sequences during a second embodiment of the tightness verification.

FIG. 4 shows the temporal course of a tightness verification with a stop valve 13 that has a membrane that opens slightly at a specified negative pressure 48 that lies below the switching pressure 33. It shows the paths of the vehicle speed 39 (v), the volumetric flow 40 through the tank venting valve 14 (CPS_F), the pressure 41 inside the tank venting system (DTP), the switching status 42 of the pressure switch (S), and the degree of opening 43 of the stop valve 13 generated by means of a PWM signal. In a slight modification to FIG. 2, the three periods indicated with Roman numerals represent the following: period I is again the initial phase; the initial pressure below the switching pressure 22 is achieved in period II; and the pressure build-up for the tightness verification takes place in period III.

Once the vehicle speed 39 has dropped below a threshold value 45 of 10 km/h for example at point in time 44, the tank venting valve 14 is opened. The stop valve 13 remains closed, as can be seen from its degree of opening 43. As a consequence of the opening of the tank venting valve 14, the pressure 41 in the tank venting system drops, so that, at point in time 46, it drops below the switching pressure 33. The pressure 41 continues to drop until it reaches the specified negative pressure 48 at point in time 47 at which the membrane of the stop valve 13 opens a little on its own. Because this process is not controlled, no change can be seen in the path of the controlled degree of opening 43. However, the slight opening of the membrane stops any further pressure reduction, which creates a virtual equilibrium around the specified negative pressure 48, wherein the value of the negative pressure 48 that is currently present depends on the fuel fill level and the current temperature. At point in time 49, the vehicle speed 39 reaches zero. However, the tank venting valve 14 is not closed until after a predetermined duration of period II expires at point in time 50. The duration of period II is determined beforehand using measurements or model calculation and in such a way that the specified negative pressure 48 is reliably reached following the expiry of the period. This should be the case after a few seconds. So that the observed increase in pressure 41 after point in time 50 is not distorted, a pulse 51 is emitted to the stop valve 13 at the exact time that the tank venting valve 14 closes, so that the membrane of the stop valve is abruptly pushed closed. The duration between point in time 50 and the next time the pressure exceeds the switching pressure 33 at point in time 52 can be used again as an indicator for any leak present in the tank venting system, i.e. the shorter the period, the more likely it is that a leak is present.

In order to move the level of the specified negative pressure 48, in an alternative embodiment, the stop valve is very slightly opened in a controlled manner during periods I and II, that is until the tank venting valve 14 is closed at point in time 50, as is shown with path 53.

The invention claimed is:

1. A method for verifying the tightness of a tank venting system of a motor vehicle, wherein the tank venting system comprises:

a tank venting valve in a regeneration line, which connects a storage container collecting fuel vapor from a fuel tank to an intake pipe of an internal combustion engine, a stop valve for sealing the tank venting system so that it is air-tight against an atmosphere prevailing outside the vehicle and a bistable pressure switch, the switching states of which indicate that the pressure in the tank venting system is above or below a predetermined switching pressure, the method comprising the steps:

waiting for the vehicle speed to drop below a threshold, opening the tank venting valve, controlling the stop valve such that the pressure in the tank venting system alternates from above the switching pressure to below the switching pressure, thereby toggling the bistable pressure switch, closing the tank venting valve when a negative pressure has been attained that is below the switching pressure, measuring the period from an initial pressure that is below the switching pressure until the next time the pressure exceeds the switching pressure, assessing the tightness using the measured duration.

2. The method according to claim 1, wherein once the tank venting valve is opened, a constant volumetric flow through the tank venting valve is regulated by means of varying the degree of opening of said valve and that the stop valve is opened at the same time as the tank venting valve and the degree of opening of the stop valve is varied such that the pressure alternately drops below, exceeds and then again drops below the switching pressure at least once in succession, whereupon the stop valve is closed, while the tank venting valve remains open for a defined period.

3. The method according to claim 2, wherein the duration between the closing of the stop valve and the next time the pressure exceeds the switching pressure is determined as the sum of defined duration and the duration until the switching pressure is exceeded.

4. The method according to claim 2, wherein the stop valve is closed when the vehicle speed has reached zero.

5. The method according to claim 2, wherein, during the varying of the degree of opening of the stop valve, a value for escaping fuel vapor is determined from the regulated cycle of changes of pressure above and below the switching pressure and from a value for the charge state of the storage container with fuel vapor.

6. The method according to claim 1, wherein a membrane is provided which is able to form a connection between the tank venting system and the atmosphere prevailing outside the vehicle, whereby the membrane opens slightly at a specified negative pressure that is less than the switching pressure, and that the tank venting valve is held open after the pressure has dropped below the switching pressure for the first time until the specified negative has been reliably achieved.

7. The method according to claim 6, wherein the stop valve is actuated with a pulse at the same time the tank venting valve closes and that the membrane is thus abruptly closed.

8. The method according to claim 7, wherein the stop valve is actuated before the pulse in such a way that there is a constant and very small degree of opening.

9. The method according to claim 6, wherein the tank venting valve is not closed until the vehicle speed has reached zero.

10. The method according to claim 1, wherein, during the measuring of the duration until the switching pressure is exceeded, the vehicle is monitored to determine whether it still has a vehicle speed of zero.

11. A system for verifying the tightness of a tank venting system of a motor vehicle, comprising:

a tank venting valve in a regeneration line, which connects a storage container collecting fuel vapor from a fuel tank to an intake pipe of an internal combustion engine, a stop valve for sealing the tank venting system so that it is air-tight against an atmosphere prevailing outside the vehicle and a bistable pressure switch, the switching states of which indicate that the pressure in the tank venting system is above or below a predetermined switching pressure, wherein the system is operable to wait for the vehicle speed to drop below a threshold, open the tank venting valve, control the stop valve such that the pressure in the tank venting system alternates from above the switching pressure to below the switching pressure, thereby toggling the bistable pressure switch, close the tank venting valve when a negative pressure has been attained that is below the switching pressure, measure the period from an initial pressure that is below the switching pressure until the next time the pressure exceeds the switching pressure, and to assess the tightness using the measured duration.

12. The system according to claim 11, wherein once the tank venting valve is opened, the system is operable to regulate a constant volumetric flow through the tank venting valve by means of varying the degree of opening of said valve and to open the stop valve at the same time as the tank venting valve and the degree of opening of the stop valve is varied such that the pressure alternately drops below, exceeds and then again drops below the switching pressure at least once in succession, whereupon the stop valve is closed, while the tank venting valve remains open for a defined period.

13. The system according to claim 12, wherein the duration between the closing of the stop valve and the next time the pressure exceeds the switching pressure is determined as the sum of defined duration and the duration until the switching pressure is exceeded.

14. The system according to claim 12, wherein the stop valve is closed when the vehicle speed has reached zero.

15. The system according to claim 12, wherein, during the varying of the degree of opening of the stop valve, a value for escaping fuel vapor is determined from the regulated cycle of changes of pressure above and below the switching pressure and from a value for the charge state of the storage container with fuel vapor.

16. The system according to claim 11, comprising a membrane which is able to form a connection between the tank venting system and the atmosphere prevailing outside the vehicle, whereby the membrane opens slightly at a specified negative pressure that is less than the switching pressure, and that the tank venting valve is held open after the pressure has dropped below the switching pressure for the first time until the specified negative has been reliably achieved.

17. The system according to claim 16, wherein the stop valve is actuated with a pulse at the same time the tank venting valve closes and that the membrane is thus abruptly closed.

18. The system according to claim 17, wherein the stop valve is actuated before the pulse in such a way that there is a constant and very small degree of opening.

19. The system according to claim 16, wherein the tank venting valve is not closed until the vehicle speed has reached zero.

20. The system according to claim 11, wherein, during the measuring of the duration until the switching pressure is exceeded, the vehicle is monitored to determine whether it still has a vehicle speed of zero.

* * * * *